United States Patent [19]

Alexander, III

[11] 4,422,479

[45] Dec. 27, 1983

[54] LOOM CLOTH TAKE-UP AND METHOD

[76] Inventor: William J. Alexander, III, P.O. Box 848, Mauldin, S.C. 29662

[21] Appl. No.: 290,732

[22] Filed: Aug. 6, 1981

[51] Int. Cl.[3] ..... D03D 49/00; D03D 49/20

[52] U.S. Cl. ..... 139/1 R; 139/304

[58] Field of Search ..... 139/304, 311, 97, 99, 139/1 R; 242/68, 68.7; 318/347

[56] References Cited

U.S. PATENT DOCUMENTS

| | | | |
|---|---|---|---|
| 2,447,227 | 8/1948 | Bergstrom | 139/97 |
| 3,160,376 | 12/1964 | Kennedy et al. | 139/1 R |
| 3,221,237 | 11/1965 | Kalenian | 318/347 |
| 3,265,094 | 8/1966 | Baird | 139/1 R |
| 3,828,827 | 8/1974 | Witt et al. | 139/304 X |

FOREIGN PATENT DOCUMENTS

| | | | |
|---|---|---|---|
| 555857 | 1/1957 | Italy | 139/97 |
| 447971 | 3/1968 | Switzerland | 139/1 R |

*Primary Examiner*—James Kee Chi

*Attorney, Agent, or Firm*—Ralph Bailey

[57] ABSTRACT

An on-loom take-up apparatus having increased cloth roll capacity is illustrated wherein means are provided for maintaining the loom supported in raised position while removing obstructions to the cloth roll as would limit the size of the cloth roll as would otherwise be permitted by the raising of the loom. A separate D.C. drive is provided and a constant torque control is provided for driving the take-up roll responsive to tension in the cloth through a positive drive arrangement.

1 Claim, 4 Drawing Figures

Fig. 3.
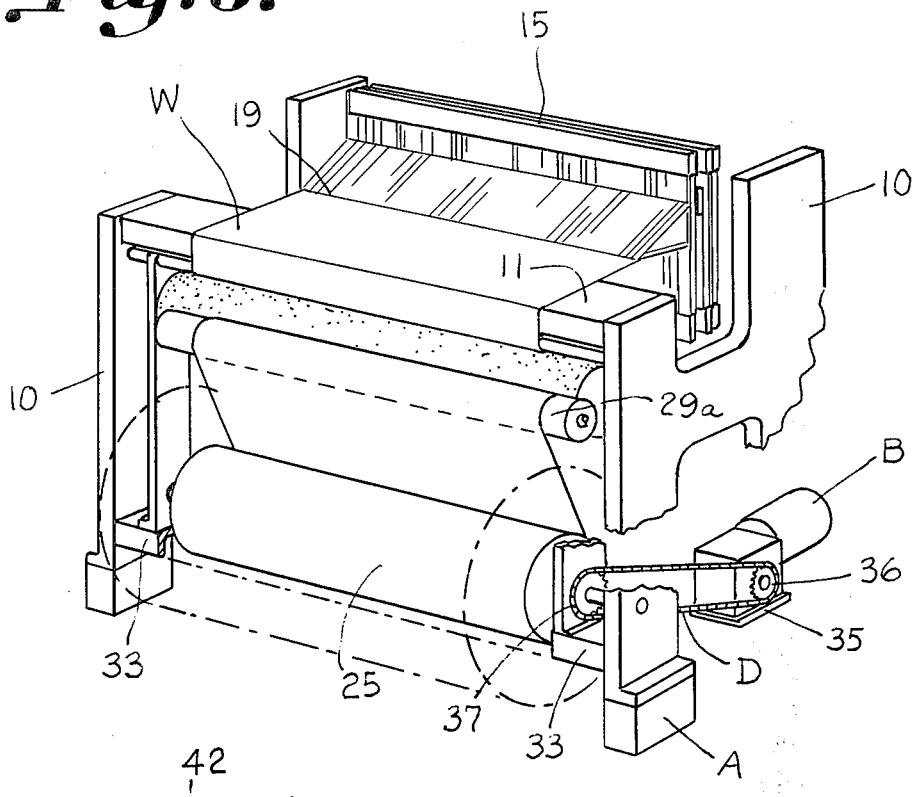
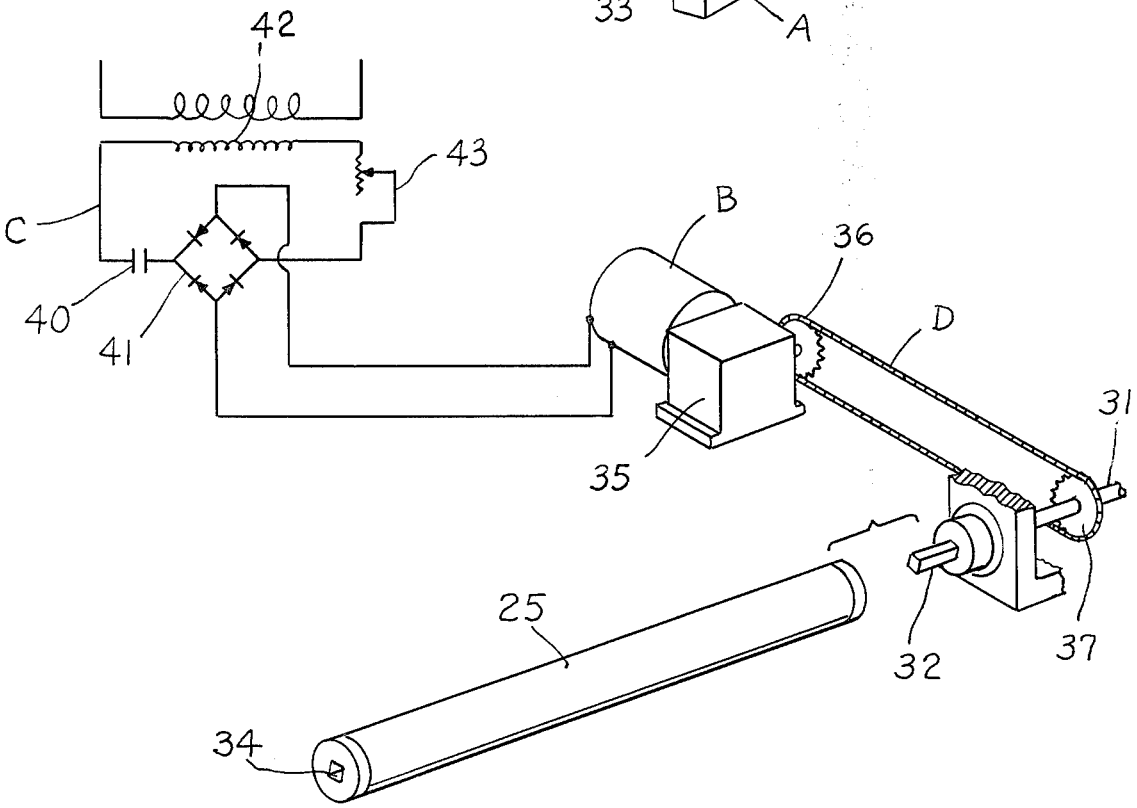
Fig. 4.

LOOM CLOTH TAKE-UP AND METHOD

BACKGROUND OF THE INVENTION

Apparatus for increasing the size of loom cloth take-up rolls are numerous and have been developed in a number of ways. Perhaps the most common way includes positioning the cloth roll on a take-up separate from the loom, usually in front of the loom so as to permit an increased size of the cloth roll such as illustrated in U.S. Pat. No. 3,433,430. Another expedient is illustrated in U.S. Pat. No. 2,644,490, and contemplates positioning the cloth take-up mechanism on a floor beneath the loom. Other means for increasing the size of the cloth roll include the positioning of the cloth roll on the loom toward the rear of the loom, with the cloth passing beneath the loom as illustrated in U.S. Pat. No. 3,677,305. Such apparatus involves considerable expense and results in the provision of separate frames and supports which either increase the floor space to be devoted to the equipment or else adds to the overall complexity of the arrangement. Other devices for mounting the cloth roll separate from the loom include separate frames such as illustrated in U.S. Pat. Nos. 3,884,271 and 3,911,966.

Accordingly, it is an important object of the present invention to provide a practical on-loom cloth take-up arrangement which will permit a greatly increased size of cloth roll.

This is accomplished essentially by raising and supporting the loom in raised position while removing obstructions as would otherwise limit the size of the cloth roll, while providing a drive, preferably controlled by tension in the cloth, which is separate from the other driving mechanism for powering the loom.

Another object of the invention is to reduce wear and friction on other loom parts as by taking the load off of loom gearing while permitting larger cloth rolls.

Another important object of the present invention is to provide a more efficient loom drive and cloth take-up since static friction as in a clutch as presently required is eliminated and controlled more nearly uniform tension is provided for building a large and improved cloth roll more efficiently and inexpensively.

SUMMARY OF THE INVENTION

A loom cloth take-up apparatus and method contemplates the provision of means for raising and supporting the loom after having removed obstructions from the loom such as the front girt as would limit the size of the roll, while providing a separate drive for building the larger size roll under full control at all times, even during the extremes of building. This is accomplished through the use of a separate D.C. drive motor which is independent of any other driving mechanism of the loom while utilizing electrical control apparatus responsive to cloth tension providing a controlled torque for providing power for transmission to the cloth roll through a positive non-slip drive such as a timing belt.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a perspective view further illustrating the cloth roll positioning and drive mechanism shown in FIGS. 1 and 2, and FIG. 4 is a schematic view illustrating the power control mechanism for the cloth roll drive constructed in accordance with the invention.

DESCRIPTION OF A PREFERRED EMBODIMENT

Figure 1:
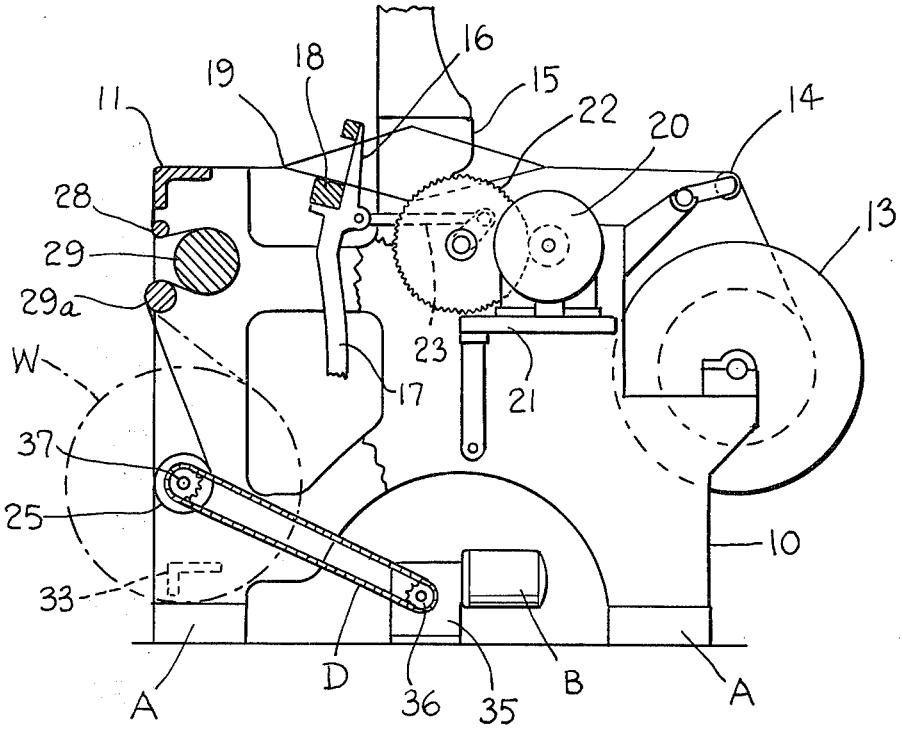
FIG. 1 is a side elevation illustrating a loom modified and having a take-up constructed in accordance with the present invention and illustrating a method of operation, in accordance with the invention.
Figure 2:
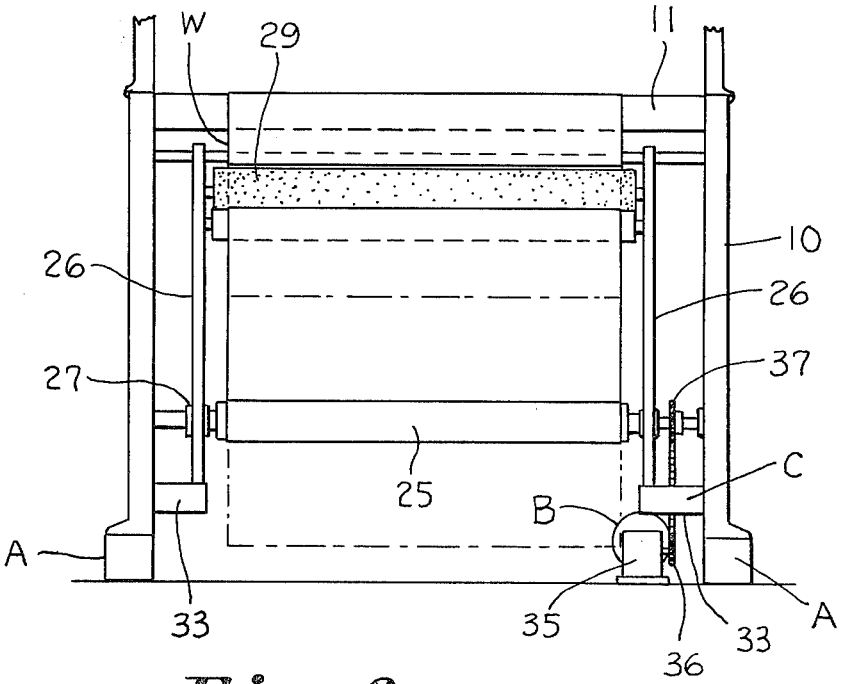
FIG. 2 is a front elevation further illustrating the loom shown in FIG. 1.

The drawings illustrate a loom cloth take-up for increasing the capacity of a cloth carried by a front portion of the loom frame. A loom support means A may be provided for raising the loom to permit the build of a cloth roll of predetermined increased size after removal of loom obstructions. A D.C. drive Motor B is independent of any other driving element. An electrical torque control C operates the motor for producing constant torque as the take-up roll builds responsive to cloth tension. A positive non-slip drive D is provided between the motor a d the take-up roll. The positive drive structure is provided in the form of a chain drive or other means such as a timing belt. The method contemplates removing transverse obstructing loom members which support the loom in raised position so as not to limit the increased size of cloth roll accommodated by raising of the loom. By driving the takeup roll independently of other loom driving mechanism through a controlled torque non-slip drive, a large roll may be built on the loom.

Referring more particularly to the drawings, a loom is illustrated as having side frame members 10 which are bridged at the front by a breast beam 11 over which the cloth W passes. The cloth is illustrated as being formed from the warp yarns which come from a warp beam 13 mounted at the rear of the loom. The warp yarns pass over the usual whip roll 14 from whence they pass through the heddles 15 and thence to the reed 16. The reed is positioned upon a sword 17 as is the lay 18. The fell of the cloth being woven is illustrated at 19.

A standard loom motor 20 is carried by a suitable motor support 21 to drive a crank shaft gear 22 which is illustrated as driving the sword 17 through the crank arm 23. Normally, the loom motor described above also drives the cloth roll 25 through a friction clutch. In this instance, however, the cloth roll 25 is positioned upon a stand 26 which has bearings 27 for supporting the cloth roll 25. The cloth W is illustrated as passing downwardly over a guide roll 28 to the roll 29 from whence it passes over another guide roll **29*a* to the cloth roll 25**.

The loom is illustrated as being elevated or supported upon suitable support means schematically illustrated as blocks A. The cloth roll is driven by a sprocket 37 which is carried upon a shaft 31 which, in turn, has a squared shank 32 for being received within a complimentary opening 34 within the cloth roll 25. It is important to note that the front girt, the stubs of which are illustrated at 33 extending inwardly from each of the frames 10, is removed. The stubs 33 support the bearings 27 and the stands 26. The size of the cloth roll, however, is not limited because the central portion of the front girt is thus removed.

The motor B through a suitable gear reducer 35, drives a sprocket 36 which carries a timing belt forming part of a positive drive D for driving the sprocket 37. The motor B is a D.C. permanent magnet motor powered by the constant torque control which utilizes a capacitor 40 to limit current to the motor so that it operates as a torque drive. In other words, the tension in the fabric determines the speed of the motor. The drive is illustrated as including the capacitor 40 as well as the rectifier network 41 and is energized by a step-down transformer 42 from line voltage. Settings for the circuit are varied by means of the variable transformer 43. The control circuitry is more fully described in U.S. Pat. No. 3,221,237 which is incorporated and made a part hereof by reference. Such control circuitry maintains controlled tension in the cloth in spite of varying conditions. An adjustable tension electric motor drive system, such as illustrated includes the usual D.C. motor armature in series with the condensor and the rectifier for the alternating current source. Thus, a considerable negative slope in the motor characteristic is imparted by the use of a capacitor and the like in the motor circuit. Thus, changes in motor loading are utilized to sense and control speed to maintain a preset fabric tension level. Changes in fabric tension are thus utilized to control motor speed.

An important characteristic of the motor and control is the increase in torque produced thereby when the motor is slowed down as the size of the cloth roll increases through increased tension in the cloth. If desired, a dancer roll could be used to provide a similar motor control responsive to cloth tension. Motor and controls having similar characteristics may be substituted for the D.C. motor and control.

It is thus seen that a larger cloth roll having a more nearly uniform wind of cloth is possible. The separate tension control may be varied as needed in contrast to that of a conventional loom when threaded means and the like must be tightened or loosened to control a mechanical friction means.

While a preferred embodiment of the invention has been described using specific terms, such description is for illustrative purposes only, and it is to be understood that changes and variations may be made without departing from the spirit or scope of the following claims.

What is claimed is:

1. A method of enlarging the cloth take-up capacity of a loom having a center wind take-up roll carried by a front frame portion of the loom comprising the steps of:

raising and supporting the loom in raised position;

removing transverse obstructing loom members to permit increased size capacity for a wound roll of cloth accommodated by the raising of the loom;

positioning the take-up roll on the loom between the side frame members so that a major portion of the take-up roll is carried within the side frame members;

driving the take-up roll independently of other loom driving mechanism through a non-slip driver to center wind cloth produce by the loom; and controlling the driving of the take-up responsive to tension in the cloth by limiting current to a D.C. motor driving the take-up roll.

* * * * *